US007637753B2

(12) United States Patent
Wong et al.

(10) Patent No.: US 7,637,753 B2
(45) Date of Patent: Dec. 29, 2009

(54) GROUND CLAMP

(76) Inventors: Harry Wong, 507 Camiino Verde, South Pasadena, CA (US) 91030; Qiang Li, 528 Xiwang Road, Malu, Jiading, Shanghai (CN) 201801

( * ) Notice: Subject to any disclaimer, the term of this patent is extended or adjusted under 35 U.S.C. 154(b) by 0 days.

(21) Appl. No.: 12/380,722

(22) Filed: Mar. 3, 2009

(65) Prior Publication Data

US 2009/0227152 A1 Sep. 10, 2009

(51) Int. Cl.
*H01R 13/648* (2006.01)

(52) U.S. Cl. ..... 439/92; 439/772

(58) Field of Classification Search ..... 439/92, 439/100, 822, 829, 923, 476.1, 481, 772
See application file for complete search history.

(56) References Cited

U.S. PATENT DOCUMENTS

| | | | | | |
|---|---|---|---|---|---|
| 1,704,305 | A * | 3/1929 | Smith | 439/477 |
| 2,000,665 | A * | 5/1935 | Neal | 439/440 |
| 2,514,130 | A * | 7/1950 | Jones | 81/370 |
| 2,731,932 | A * | 1/1956 | Petersen | 81/311 |
| 3,188,602 | A * | 6/1965 | Toedtman et al. | 439/479 |
| 3,234,497 | A * | 2/1966 | Condry | 439/476.1 |
| 3,737,832 | A * | 6/1973 | Anderson | 439/822 |
| 3,840,843 | A * | 10/1974 | Izraeli | 439/180 |
| 3,988,051 | A * | 10/1976 | Robinson | 439/772 |
| 4,475,728 | A * | 10/1984 | Haddad | 269/94 |
| 4,758,188 | A * | 7/1988 | Yates | 439/759 |
| 4,820,901 | A * | 4/1989 | Peviani | 219/138 |
| 4,826,457 | A * | 5/1989 | Varatta | 439/755 |
| 4,889,021 | A * | 12/1989 | Morrison | 81/325 |
| 5,021,008 | A * | 6/1991 | Scherer | 439/504 |
| 5,041,028 | A * | 8/1991 | Stohle | 439/822 |
| 5,046,958 | A * | 9/1991 | Brown | 439/92 |
| 5,197,359 | A * | 3/1993 | Mills | 81/324 |
| 5,537,727 | A * | 7/1996 | Mayer | 29/237 |
| 5,802,690 | A * | 9/1998 | Bullock | 29/237 |
| 6,572,390 | B2 * | 6/2003 | Ladin | 439/92 |
| 6,626,070 | B2 * | 9/2003 | Peperkorn et al. | 81/370 |
| 6,638,101 | B1 * | 10/2003 | Botelho | 439/504 |
| 6,899,552 | B1 * | 5/2005 | Robinson et al. | 439/92 |
| 7,160,142 | B2 * | 1/2007 | Hughes et al. | 439/479 |

* cited by examiner

*Primary Examiner*—Ross N Gushi

(57) ABSTRACT

A clamping device utilizing the mechanism of conventional vise-grip or locking pliers comprises a L-shape fixed arm and a L-shape movable arm, an insulating U-shape clamping jaw which is connected to the ground cable of an arc welding system; and a floating pad attached to a threaded rod so that the effective clamping size of the clamping device is adjustable. With the U-shape clamping jaw, the clamping device is capable of clamping firmly flat workpieces of various thicknesses as well as workpieces with curved or angled surfaces and providing a good electrical contact between the ground cable of the arc welding system and the workpiece.

5 Claims, 2 Drawing Sheets

GROUND CLAMP

CLAIM OF FOREIGN PRIORITY, 35 U.S.C. § 119

The present invention claims its foreign priority filing, pursuant to the provision of 35 U.S.C. section 119 et seq, based upon the application filed by the same inventors in China, having application number 200820056012.6 filed on Mar. 7, 2008.

REFERENCE CITED

| U.S. PATENT DOCUMENTS | | |
|---|---|---|
| 4,820,901 | April 1989 | Thomas P. Peviani |
| 5,046,958 | September 1991 | Ronald Brown |

BACKGROUND OF THE INVENTION

1. Field of the Invention

The present invention relates to a class of locking pliers, or vise grips in general, and more particularly to ground clamp having L-shape clamping arms with holes to attach an insulated U-shape clamping jaw which is connected to the ground cable of an arc welding system and a floating pad attached to a threaded rod so that the effective clamping size is adjustable. Utilizing the U-shape clamping jaw, the present invention is capable of clamping firmly flat workpieces of various thicknesses as well as workpieces with curved or angled surfaces and providing a good electrical conductivity between the ground cable of the arc welding system and the workpiece.

2. Description of the Related Art

A conventional locking plier or vise grip generally comprises a fixed handle, a fixed arm with clamping jaw, a movable handle, a movable arm attached with clamping jaw and a toggling linkage mechanism attached between the movable handle and the fixed handle. In arc welding industry, ground clamps utilizing locking plier mechanism have the advantages of firm contact with the workpiece and quick release after welding. Prior art Welding Ground Clamp by Ronald Brown, U.S. Pat. No. 5,046,958 is one of the example. It shows a locking plier with U-shape fixed arm and U-shape movable arm with flat or curved clamping jaws and ground cable connection on the body of the fixed arm. It has good electrical contact surfaces for flat workpieces and matching cylindrical workpieces, but not for cylindrical workpieces of different diameter and workpieces of other shapes. Another disadvantage of this prior art is the limited opening of the clamping jaws, which limits the thickness of the workpieces that can be clamped. Yet another disadvantage of this prior art is the swing angle of the ground cable is limited to less than 90 degrees, this may cause inconvenience during the welding process. Prior art Quick Releasable Ground and Rod Clamp for Welding by Thomas P. Peviani, U.S. Pat. No. 4,820,901 is another example. It shows a locking plier with long straight fixed arm and long straight movable arm with sharp clamping jaws and ground cable connection on the body of the fixed arm. It has good contact pressure on any shape of workpieces, but it may not have good electrical contact with the workpiece for large current flow because of the small contact area. Another disadvantage of this prior art is the limited opening of the clamping jaws, which limits the thickness of the workpieces that can be clamped. Yet another disadvantage of this prior art is the difficulty in inserting and connecting the ground cable. Yet another disadvantage of this prior art is the single position of the ground cable, that means the cable cannot be positioned at a more convenient position for a particular workpiece under a particular welding environment. It is the intention of the present invention to overcome the above mentioned disadvantages.

SUMMARY OF THE INVENTION

The present invention comprises a fixed handle to which a L-shape fixed arm with insulated U-shape clamping jaw is attached, a movable handle to which a L-shape movable arm with screw-in floating pad is pivotally mounted, a toggling linkage mechanism pivotally connected between the fixed handle and the movable handle, an adjustment screw inserted into the free end of the fixed handle, and a L-shape handle inserted to a round hole at the free end of the adjustment screw. The fixed handle, the movable handle, the adjustment screw and the toggling linkage mechanism are similar in design as the conventional locking pliers. The principle of operations of these parts will not be discussed here again.

At the free end of the L-shape fixed arm, a round hole is equipped for the insertion of an U-shape clamping jaw. The U-shape clamping jaw comprises a U-shape metal plate with a metal connecting ear bending downwards at 90 degree to the bottom surface of the U-shape metal plate, a metal screw with nut attached perpendicularly to the surface of the connecting ear, and a threaded shank attached vertically to the bottom surface of the U-shape metal plate. The U-shape clamping jaw is mounted to the free end of the L-shape fixed arm by inserting the threaded shank through an insulating washer and an insulating collar to the round hole from the bottom upward and locked by a nut with an insulating washer in between. The ground cable of the arc welding system is connected and fixed to the metal connecting ear through the metal screw and the nut. The spatial relationship between the connecting ear and the U-shape metal plate will keep the ground cable away from the workpiece during the welding process. On the other hand, the angle of the ground cable is 360 degree adjustable so that the best position can be achieved for any welding environment. The short distance between the connecting ear and the U-shape metal plate ensures the shortest electrical path between the ground cable and the workpiece too. The U-shape metal plate is made to be flat at the bottom for the mounting of the threaded shank. The U-shape metal plate is also made to have two flat surfaces with round corners on top for clamping the workpiece. The two flat surfaces will provide good electrical contact with the workpiece having flat surface while the round corners will increase the contact area with the workpiece having curved surface or angled surfaces.

The U-shape clamping jaw is insulated from the L-shape fixed arm so that the welding current will not go to the fixed arm and generating heat.

At the free end of the movable arm, a round threaded hole is equipped for the insertion of the threaded rod attached to a floating pad. The distance between the floating pad and the movable arm is adjustable and fixed by a locking nut. This design enables the adjustment of the gap between the floating pad and the U-shape metal plate. Combining the L-shape fixed arm and L-shape movable arm, the effective clamping size and the flexibility of the present invention is maximized to suit different sizes and different shapes of workpieces.

Contact pressure is one of the factors affecting the electrical conductivity between the ground cable of the arc welding system and the workpiece. The contact pressure of the present invention is adjustable through the turning of the adjustment screw at the free end of the fixed handle. Tightening the adjustment screw will increase the contact pressure. If larger contact pressure is required, the L-shape handle at the end of the adjustment screw can be utilized to increase the turning torque.

DETAILED DESCRIPTION OF THE INVENTION

With the help of the drawings and the detail description below, the features of the present invention will be apparent and fully understandable.

Figure 1:
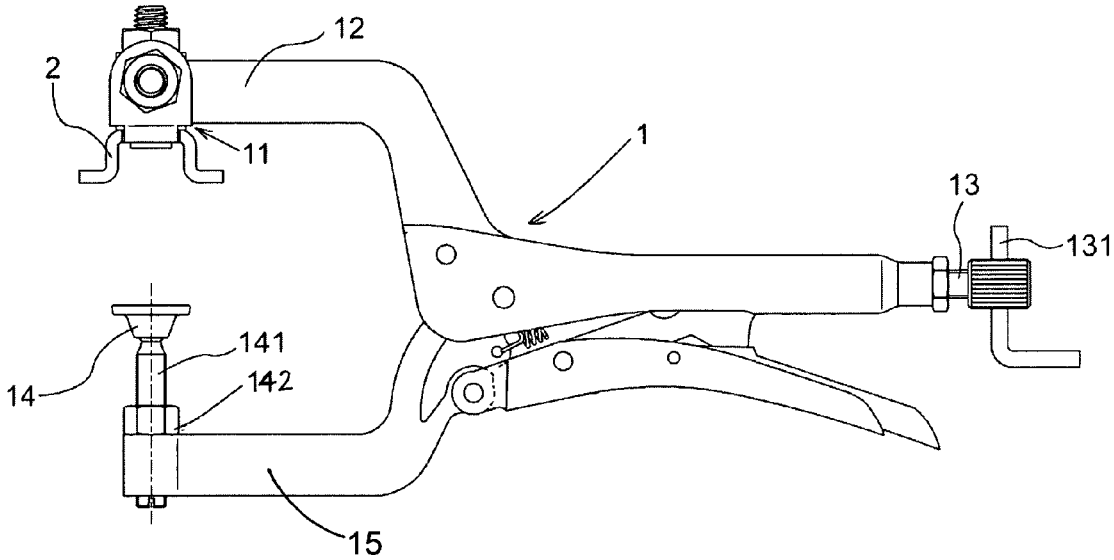
FIG. 1 is a side elevation of the present invention.

Referring to FIG. 1, the present invention 1 comprises a fixed handle to which a L-shape fixed arm 12 is attached, a movable handle to which a L-shape movable arm 15 is pivotally mounted, a U-shape clamping jaw 11 mounted to the free end of the L-shape fixed arm 12, a floating pad 14 mounted to the free end of the L-shape movable arm 15 through threaded rod 141 and nut 142, an adjustment screw 13 and a L-shape handle 131.

Figure 2:
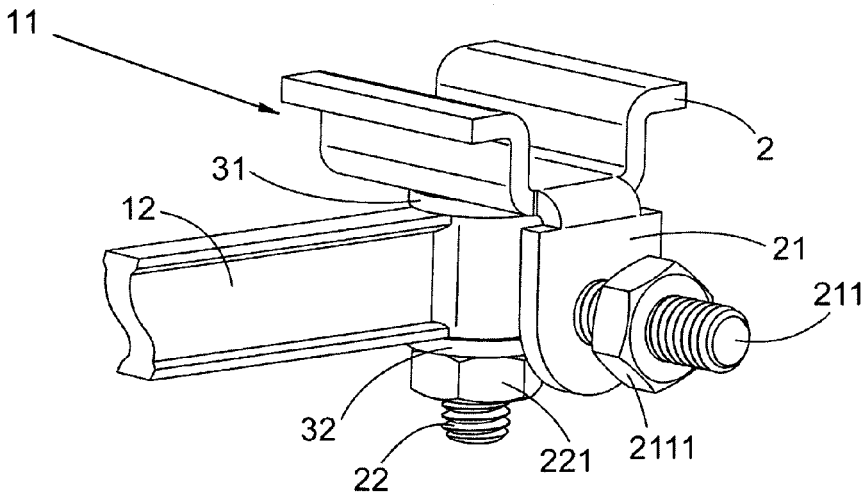
FIG. 2 is a perspective view of the U-shape clamping jaw attached to one end of the fixed arm.
Figure 3:
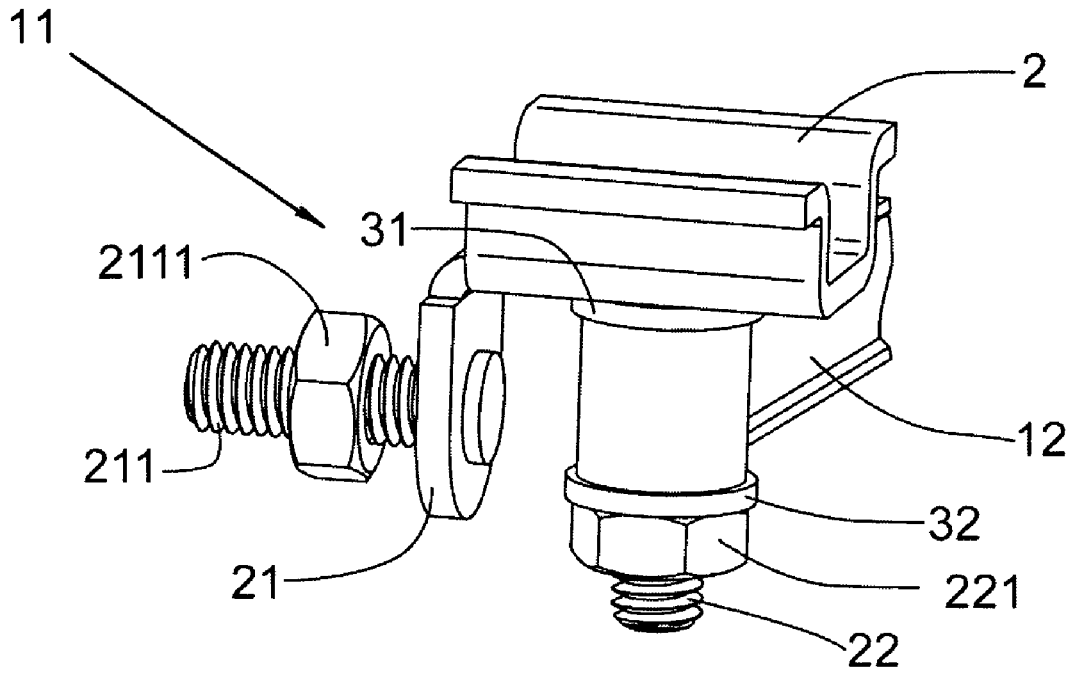
FIG. 3 is a perspective view of the U-shape clamping jaw attached to one end of the fixed arm as seen from another angle.

Referring to FIG. 1, FIG. 2 and FIG. 3, the U-shape clamping jaw 11 comprises a U-shape metal plate 2 with a metal connecting ear 21 bending downwards at 90 degree to the bottom surface of the U-shape metal plate 2, a metal screw 211 attached perpendicularly to the surface of the connecting ear 21, a nut 2111 for locking the ground cable (not shown), a threaded shank 22 attached vertically to the bottom surface of the U-shape metal plate 2, and a nut 221 inserted over threaded shank 22. The U-shape metal plate 2 is inserted with the attached threaded shank 22 to the free end of the L-shape fixed arm 12 through an insulating washer 31 and an insulating collar (not shown), then metal plate 2 is locked in position with nut 221 and insulating washer 32. The angular position of the U-shape clamping jaw 11 relative to the fixed arm 12 is 360 degree adjustable with the threaded shank 22 and nut 221. The ground cable (not shown) of an arc welding system is connected and fixed to the metal connecting ear 21 through metal screw 211 and nut 2111. The angular position of the ground cable (not shown) relative to the fixed arm 12 is also adjustable through 360 degrees. Combining the design features of adjustable angular position of the U-shape clamping jaw 11 and adjustable angular position of the ground cable (not shown) will make the present invention 1 suitable for all the different welding environments. The U-shape metal plate 2 consists of two flat contact surfaces with round corners on top for contacting with workpiece with flat or curved surfaces. The relatively larger contact area ensures good electrical conductivity between the ground cable (not shown) and the workpiece. The insulating washers 31 and 32, insulating collar (not shown) ensure that the current of arc welding process will flow through the U-shape clamping jaw 11 only but not the body of the L-shape fixed arm 12.

Again referring to FIG. 1, the clamping gap between floating pad 14 and the U-shape clamping jaw 11 is adjustable through the turning in and out of the adjustment screw 13. The distance between the floating pad 14 and the free end of movable arm 15 is also adjustable through threaded rod 141 and nut 142. With the L-shape design of the fixed arm 12 and movable arm 15, the effective clamping gap between floating pad 14 and the U-shape clamping jaw 11 is greatly increased. This will increase the flexibility of the present invention. Once the workpiece is clamped between the U-shape clamping jaw 11 and the floating pad 14, the clamping force can be increased by turning adjustment screw 13 to ensure good electrical contact between the ground cable (not shown) and the workpiece. With the help of the L-shape handle 131, larger clamping force can be reached and hence the best electrical conductivity will be obtained.

We claim:

1. A ground clamp having a fixed handle and a movable handle linked together by a spring and a toggling linkage mechanism similar to the design of a conventional locking plier comprising:

a L-shape fixed arm with one end riveted to a first end of said fixed handle and the other end made to be cylindrical in shape with a round hole;

a L-shape movable arm with one end pivoted to one end of said movable handle and the other end made to be cylindrical in shape with a threaded hole;

an U-shape clamping jaw mounted to said round hole of said fixed arm through electrically insulating means;

a floating pad with threaded rod attached to said threaded hole of said movable arm;

an adjustment screw inserted into a second end of said fixed handle, said adjustment screw having a cylindrical head with a cylindrical hole made perpendicular to its axis; and a L-shape handle inserted to said cylindrical hole of said adjustment screw.

2. The ground clamp according to claim 1, wherein said electrically insulating means comprises a cylindrical collar and two washers, said cylindrical collar and said washers are made of electrically non-conductive materials.

3. The ground clamp according to claim 1, wherein said U-shape clamping jaw comprises a U-shape metal plate with a metal connecting ear bending downwards; a threaded shank attached vertically to the bottom of said U-shape metal plate; and a metal screw with nut attached perpendicularly to the surface of said connecting ear.

4. The ground clamp according to claim 3, wherein said U-shape metal plate is made of copper.

5. The ground clamp according to claim 3, wherein said U-shape metal plate comprises two flat surfaces with round (cylindrical) corners.

* * * * *